United States Patent [19]

Rudak et al.

[11] 4,221,300

[45] Sep. 9, 1980

[54] LOAD-LIFTING CRANE

[76] Inventors: Gennady I. Rudak, prospekt Oktyabrskoi Revoljutsii, 35, kv. 67; Iosif M. Berkhin, prospekt Gagarina, 17, kv. 35; Gennady V. Kravchenko, ulitsa Repina, 30, kv. 95; Kamilla S. Dmitrieva, prospekt Pobedy, 36, kv. 95; Vladimir I. Bocharov, prospekt Oktyabrskoi Revoljutsii, 33, kv. 95; Julian V. Kuzmenko, prospekt Ostryakova, 21, kv. 18; Alexandr S. Kharkovsky, ulitsa Bljukhera, 13, kv. 29; Igor V. Kononov, ulitsa Repina, 8, kv. 61; Igor V. Felenkovsky, ulitsa Repina, 12, kv. 12; Nikolai D. Velikoselsky, prospekt Gagarina, 15, kv. 29; Arnold A. Gudze, ulitsa Repina, 13, kv. 2, all of Sevastopol, U.S.S.R.

[21] Appl. No.: 934,262

[22] Filed: Aug. 16, 1978

[51] Int. Cl.[2] ..... B66C 23/68

[52] U.S. Cl. ..... 212/192

[58] Field of Search ..... 212/8 R, 58 R, 59 R, 212/59 A, 3 R, 3 A

[56] References Cited

U.S. PATENT DOCUMENTS

| | | | |
|---|---|---|---|
| 1,920,370 | 8/1933 | Forsythe | 212/8 R X |
| 3,868,022 | 2/1975 | Greenlay et al. | 212/8 R |

*Primary Examiner*—Robert G. Sheridan

*Attorney, Agent, or Firm*—Fleit & Jacobson; Fleit & Jacobson

[57] ABSTRACT

The load-lifting crane has a jib mounted on its framework, the end of the jib having an extension connectable thereto, the ends of the jib and of the extension carrying blocks over which a run of the rope coming from the winch is adapted to be alternatively guided to form a tackle arrangement supporting a load-engaging device. The ends, respectively, of the jib and of the extension have each mounted thereon an additional block adapted to have a run of the rope coming from the tackle, which is the double one, running over it, the end of the last-mentioned run being secured to the framework. The block over which runs the run of the rope, coming from the winch, and the respective additional block are offset relative to each other laterally of the jib by an extent not short of the diameter of the rope. The extension is connected to the jib for rotation about a horizontal axle mounted on the jib adjacent to the blocks thereof, on the framework-facing side, whereby with the extension being rotated, the rope is guided over from the blocks of the jib onto those of the extension.

3 Claims, 5 Drawing Figures

LOAD-LIFTING CRANE

FIELD OF THE INVENTION

The invention relates to load-handling machinery, and, more particularly, it relates to load-lifting cranes.

It is most expedient to incorporate a load-lifting crane constructed in accordance with the invention in floating sea-going cranes provided with jib extensions for attaining an increase jib outreach and an increased load-lifting height.

DESCRIPTION OF THE PRIOR ART AND ITS DRAWBACKS

There are known load-lifting cranes including a jib mounted on a framework and a removable extension connected to the jib to extend the latter's length, i.e. to provide for greater jib outreach and load-lifting height. The respective ends of the jib and of the extension have sheave blocks mounted thereon. The blocks have running over them alternatively, i.e. either the blocks on the extension, or the blocks on the jib, depending on the desirability of increasing the outreach and the load-lifting height, a run of the rope coming from a winch mounted on the framework. The rope thus forms with the blocks a tackle arrangement carrying a load-engaging device. The end of the rope coming from the tackle arrangement is secured to the end of either the jib or of the extension adjacent to their respective blocks.

The guiding over of the rope from the blocks of the jib onto the blocks of the extension, when the outreach and the load-lifting height are to be increased, is performed in the load-lifting cranes of the prior art, as follows.

The end of the rope coming from the tackle arrangement is disconnected from the jib, and the tackle formed between the blocks on the jib and those on the load engaging device is undone, the other end of the rope remaining secured to the winch. Then the run of the rope, coming from the winch, is guided over the block carried by the extension and into the tackle arrangement, whereafter the load-engaging device is secured thereto. The end of the rope is secured to the extension adjacent to the blocks thereof. Owing to the load suspension point belonging now to the extension, relatively great outreach and load-lifting height values are attained. In this known type of load-lifting cranes the entire operation of guiding the rope over from the blocks of the jib onto those of the extension, and, whenever necessary, vice versa, is performed manually.

A disadvantage of this known type of load-lifting cranes is the highly labour-consuming character of the operation of guiding over the rope from the jib blocks onto the extension blocks, and vice versa, on account of this operation being performed manually. The greater the crane capacity (with the greater capacity being reflected in the accordingly greater rope diameter), the amount of the labour required is likewise greater. Therefore, there has been created an objective need, in the case of cranes of high capacities, such as sea-going floating frames in particular, of facilitating the process of guiding the rope over from the jib onto the extension.

OBJECTS AND SUMMARY OF THE INVENTION

It is an object of the present invention to provide a structure of a load-lifting crane, wherein the guiding-over of the rope from the blocks of the jib onto the blocks of the extension and vice versa should be performable so that the process of guiding over the rope from the blocks of the jib onto the blocks of the extension should be automatable, i.e. the amount of the labour consumed by the operation should be minimized.

With this and other objects in view, disclosed herein is a load-lifting crane having a jib mounted on a framework and an extension connected to the end of the jib, the ends of the jib and of the extension having mounted thereon rope blocks over which runs alternatively the run of a rope coming from a winch and guided over either the jib or the extension, the rope and the blocks forming a tackle arrangement carrying a load-engaging device, in which load-lifting crane, in accordance with the invention, the respective ends of the jib and of the extension have each mounted thereon an additional block over which runs a run of the rope coming from the tackle arrangement, which is a double one, the last-mentioned run having its end secured to the framework, the block over which runs the run of the rope, coming from the winch, and the respective additional block being offset relative to each other laterally of the jib by an extent not short of the diameter of the rope, the extension being connected with the jib for rotation about a horizontal axle supported by the jib adjacent to its blocks, on the side facing the framework, whereby with the extension rotating, the rope is guided over from the blocks of the jib onto the blocks of the extension.

It is expedient that the additional block should be offset relative to the block over which runs the run of the rope, coming from the winch, longitudinally of the jib by an extent not short of the diameter of the block.

Owing to the blocks being offset relative to each other in the longitudinal direction, there is attained, beside the automation of the guiding-over process, a compact structure of the ends of the jib and of the extension.

It is further expedient that when the twin double tackle arrangement carrying the load-engaging device is used, the blocks over which run the runs of the ropes coming from the winch and the respective additional blocks should be arranged coaxially in pairs, one pair being offset relative to the other pair longitudinally of the jib by an extent not short of the diameter of the block, and that in the lateral direction the spacing of the blocks of one pair being short of the spacing of the blocks of the other pair by an extent at least equal to the double diameter of the rope.

The abovedescribed arrangement of the blocks and of the additional blocks with the use of the twin double tackle enables to double the number of the ropes taking part in the guiding-over, and thus to enable the crane to lift a load twice as heavy, while maintaining the automatic character of the process of the guiding-over of both ropes from the blocks of the jib onto the blocks of the extension and vice versa.

Load-lifting cranes constructed in accordance with the present invention are capable of the automatic guiding-over of the ropes from the blocks of the jib onto those of the extension and vice versa, thus completely eliminating manual labour in the rope guiding-over process and thus saving labour and time at the guiding-over of the ropes, which is particularly essential in the case of sea-going floating cranes.

BRIEF DESCRIPTION OF THE DRAWINGS

Following hereinbelow is a detailed description of an embodiment of the present invention, with reference being had to the accompanying drawings, wherein.

DESCRIPTION OF THE PREFERRED EMBODIMENT

Described hereinbelow is an embodiment of the present invention in a load-lifting sea-going floating crane, comprising a floating pontoon or hull 1 (FIG. 1) having mounted thereon for rotation about a vertical axis a framework 2 supporting a jib 3.

The drive effecting the rotation of the framework is not shown here because it is not relevant for the essence of the present invention and can be of any suitable known per se structure.

Figure 2:
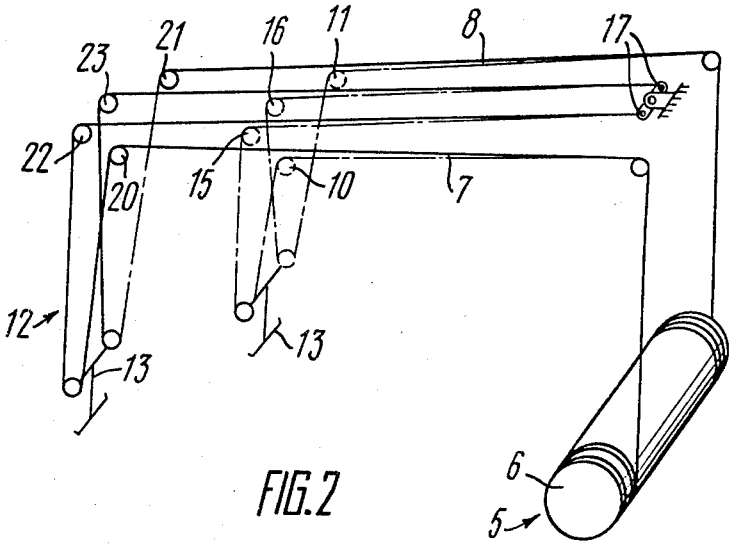
FIG. 2 is a schematic perspective view of the arrangement of the ropes on the blocks of the jib and of the extension.
Figure 3:
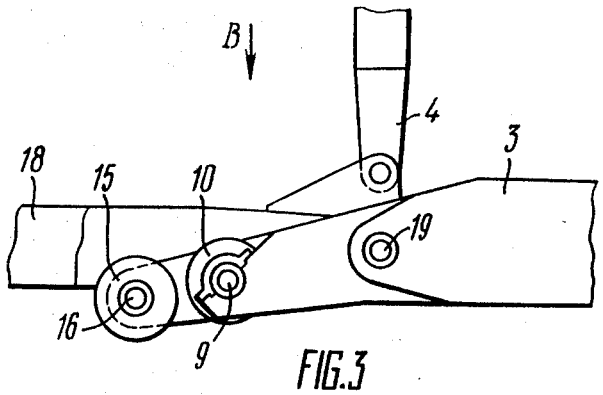
FIG. 3 is an enlarged view of the area A of FIG. 1.
Figure 4:
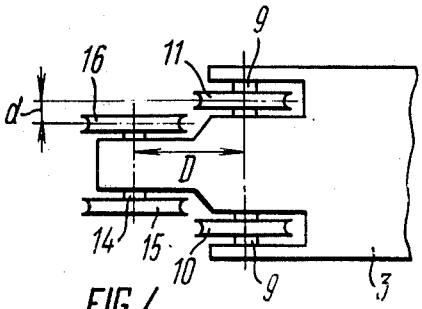
FIG. 4 is a view taken along arrow line B in FIG. 3.

The jib 3 is mounted on the framework 2 for rotation about a horizontal axle 4. Also mounted on the framework 2 is a winch 5 of which the drum 6 (FIG. 2) has secured thereto the ends of ropes 7 and 8. The free end of the jib 3 (FIG. 3) is in the form of a trident in the valleys or dents of which there are coaxially mounted axles 9 (FIG. 4) supporting thereon sheave blocks 10 and 11 over which run, respectively, the runs of the ropes 7 (FIG. 2) and 8, coming from the drum 6 of the winch 5. The ropes 7 and 8 run over the respective blocks 10 and 11 and further form a twin double tackle 12 carrying a load-engaging device 13. Mounted on the internal prong of the trident is an axle 14 supporting additional blocks 15 and 16 over which run the respective runs of the ropes 7 (FIG. 2) and 8, coming from the tackle 12. The ends of these ropes are secured to the framework 2 (FIG. 2) at a point 17 situated immediately above the axle 4 of rotation of the jib 3.

With their ends being secured in this manner, the ropes 7 and 8 (FIG. 2) run about the blocks 10 and 11 and the additional blocks 15 and 16 through an engagement angle short of 180°, which enables to reduce the wear of the ropes.

The block 10 (11) and its respective additional block 15 (16) over which the same rope 7 (8) runs are offset relative to each other laterally of the jib 3 by an extent "d" (FIG. 4) which is at least equal to the diameter of the rope 7 (8). This offset arrangement of the blocks 10, 11 relative to their respective additional blocks 15, 16 in the lateral direction prevents the contact between the runs of the ropes 7, 8, coming from the winch 5, and the runs of the same ropes, coming from the tackle 12.

The blocks 10, 11 are also offset relative to their respective additional blocks 15, 16 longitudinally of the jib 3 (FIG. 1) by an extent "D" at least equal to the diameter of the block 10. This, with the blocks 10 and 11 and the additional blocks 15 and 16 being arranged in coaxial pairs, means that the pair of the blocks 10, 11 is offset in the longitudinal direction relative to the pair of the additional blocks 15, 16 also by an extent at least equal to the diameter of the block 10. In the lateral direction the spacing of the additional blocks 15 and 16 is short of the spacing of the blocks 10 and 11 by an extent at least equal to the double diameter of the rope 7 (8).

Figure 5:
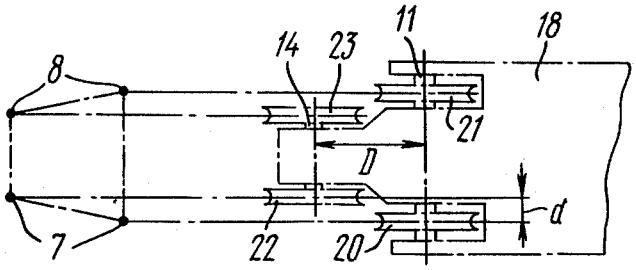
FIG. 5 is an enlarged sectional view taken on line V—V of FIG. 1.

With the abovedescribed arrangement of the blocks 10 and 11 and of the additional blocks 15, the rops 7 and 8 running off them define in space a prism which in cross-sectional view is trapezoidal, as it can be seen in FIG. 5. This three-dimensional shape ensures that at the guiding-over the runs of the ropes 7 and 8 freely leave the sheaves of the blocks 10, 11 and 15, 16.

To provide for the increasing of the outreach of the jib 3 (FIG. 1) and of the load-lifting height of the crane, the end of the jib 3 has connectable thereto an extension 18. This extension 18 is connectable to the jib 3 for rotation about a horizontal axle 19 mounted on the jib 3 adjacent to its blocks 10, 11, on the side facing the framework 2.

The axle 19 is arranged in the proximity of the blocks 10, 11 on the side facing the framework 2 so that with the extension 18 being rotated about this axle 19 into the vertical downwardly extending position, it should be positioned behind the twin double tackle 12.

The rotation of the extension 18 can be effected by any known per se means suitable for the purpose.

The free end of the extension 18 has mounted thereon blocks 20 and 21 (FIGS. 2 and 5) and additional blocks 22, 23 over which the ropes 7 and 8 are adapted to run, when they are guided over from the blocks of the jib 3 onto those of the extension 18.

The blocks 20 (FIG. 5), 21 and the additional blocks 22 and 23 of the extension 18 are mounted and arranged on the end of the extension 18 identically with the arrangement of the blocks 10 (FIG. 4), 11 and the additional blocks 15, 16 of the jib 3.

To retain the extension 18 (FIG. 1) in the position where it extends the jib 3, there is provided a strut 24 having one of its ends connected with the extension 18, and its other end connected by a rope 25 with the extension 18 and by a rope 26 with the jib 3.

In an embodiment where the load-lifting crane constructed in accordance with the invention has a single load-lifting rope, the block of the jib (of the extension) and the respective additional block of the jib (of the extension) are offset relative to each other laterally of the jib by an extent not short of the rope diameter, and longitudinally of the jib by an extent not short of the block diameter.

The guiding-over of the ropes from the blocks of the jib 3 onto those of the extension 18 is carried out, as follows.

Figure 1:
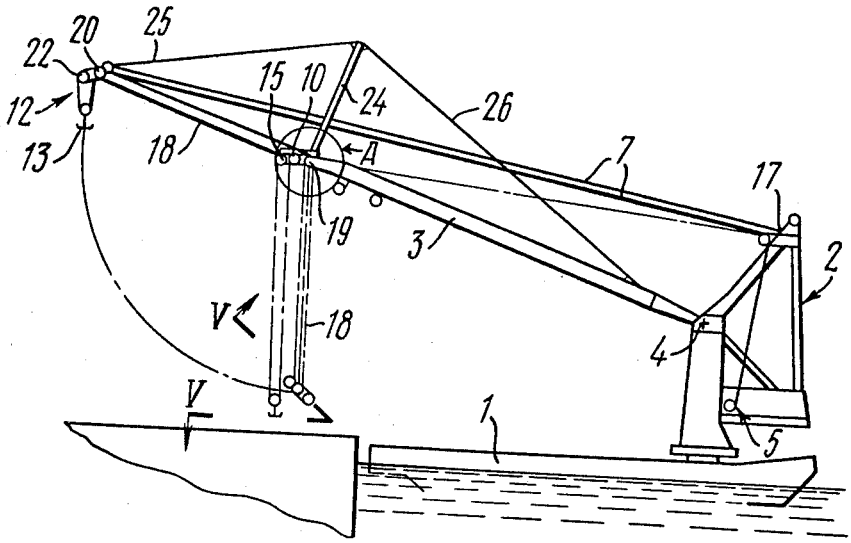
FIG. 1 is a schematic side elevation of a load-lifting crane constructed in accordance with the invention.

Some suitable external means, e.g. another crane (not shown) or a specifically provided auxiliary winch (not shown, either) mounted on the same framework 2 (the external means form no part of the present invention) are operated to rotate the extension 18 about the horizontal axle 19 into the vertically downward-extending position (shown in FIG. 1 with dash-and-dot lines). Now the extension 18 is behind the tackle arrangement 12 relative to the framework 2.

With the extension 18 being subsequently raised (also by the operation of some external means) by being rotated about the axle 19, its blocks 20, 21 and additional blocks 22, 23 have their respective sheaves engaging the runs of the ropes 7, 8; the runs of the ropes 7, 8 coming from the winch 5 being engaged by the blocks 20, 21, and the runs of the ropes coming from the tackle 12 being engaged by the additional blocks 22, 23, respectively.

With the extension 18 being thus raised further on toward its operative position (shown in FIG. 1 with solid lines), the respective runs of the ropes 7, 8 leave the sheaves of the blocks 10, 11 and those of the additional blocks 15, 16 and remain engaged by the blocks 20, 21 and additional blocks 22, 23 of the extension 18. In this way the double tackle 12 becomes associated with the end of the extension 18, which increases the outreach and the load-lifting height of the crane.

The reverse operation of guiding-over of the ropes 7, 8 from the extension 18 onto the jib 3 is carried out, as follows.

The extension 18 is lowered from the operative position into the initial or idle one, i.e. the vertically-downward extending attitude, whereby the ropes 7 and 8 freely enter the respective sheaves of the blocks 10, 11 of the jib 3 and of its additional blocks 15, 16. Upon the extension 18 having reached its downwardly extending attitude, the ropes 7, 8 have freely left the respective sheaves of the blocks 20, 21 and additional blocks 22, 23 of the extension 18 under the action of the weight of the load-engaging device 13. Upon the ropes 7, 8 having cleared the blocks of the extension 18, they form the tackle arrangement 12 between the load-engaging device 13 and the blocks 10, 11 and additional blocks 15, 16 of the jib 3.

It is expedient to operate suitable external means to remove now the extension 18 with the strut 24 and the ropes 25, 26 from the load-lifting crane, so that they would not interfere with load-handling operations of the crane.

A load is lifted in the usual way by operating the winch 6.

Thus, it can be seen that in the herein disclosed load-lifting crane the process of guiding over the ropes from the blocks of the jib onto those of the extension is effected automatically, which reduces the amount of labour consumed, since there have been eliminated from the process such arduous manual operations as undoing the end of the rope, guiding it off the blocks of the jib and onto the blocks of the extension and then securing the end of the rope to the extension.

In the description of the abovedisclosed embodiment some exact terms and expressions have been used for clarity sake. However, it should be understood that the invention is not limited to these terms and expressions, and each of them is meant to embrace its equivalents operating in a similar way and capable of serving the same purpose.

Although the present invention has been described in connection with a preferred embodiment thereof, those competent in the art would understand that various modifications and changes may be introduced without departing from the spirit and scope of the invention.

These modifications and changes should be considered as falling within the scope of the invention, as set forth in the claims to follow.

What we claim is:

1. A load-lifting crane comprising; a framework; a jib mounted on said framework; an extension connected to said jib and adapted to increase the outreach and the load-lifting height thereof; a rope winch mounted on said framework; a rope having one end thereof secured to said rope winch; a block mounted on the free end of said jib and adapted to have a run of said rope, coming from said winch, running over it; a double tackle arrangement formed by said rope; a load-engaging device suspended from said double tackle arrangement; an additional block adapted to have a run of said rope, coming from said double tackle arrangement, running over it, said additional block being mounted on the free end of said jib and offset relative to said first-mentioned block laterally of said jib by an extent at least equal to the diameter of said rope, for the runs of said ropes not to engage each other at load-handling operations; the other end cf said rope secured to said framework; a block mounted on the free end of said extension and adapted to have the run of said rope, coming from said winch, running over it; an additional block adapted to have the run of said rope, coming from said double tackle arrangement, running over it, said last-mentioned additional block being mounted on the free end of said extension and offset relative to said block of said extension laterally of said jib by an extent at least equal to the diameter of said rope; said extension being connected with said jib for rotation about a horizontal axle mounted on said jib adjacent to said first-mentioned block thereof and to said additional block thereof, on the side facing said framework, whereby with said extension being rotated, said rope is guided over from said blocks of said jib onto said blocks of said extension.

2. A load-lifting crane as set forth in claim 1, wherein each said additional block is offset relative to the respective one of said blocks adapted to have the run of said rope, coming from said winch, running over it, longitudinally of said rope by an extent at least equal to the diameter of said block.

3. A load-lifting crane as set forth in claim 1, wherein, with a twin double tackle arrangement being used, said arrangement carrying the load-lifting device; said blocks adapted to have the runs of said rope, coming from said winch, running over them, and the respective ones of said additional blocks are arranged in coaxial pairs, one pair being offset relative to the other one longitudinally of said jib by an extent at least equal to the diameter of said block, the lateral spacing of the blocks of one pair being short of the lateral spacing of the blocks of the other pair by an extent at least equal to the double diameter of said rope.

* * * * *